US006233780B1

(12) United States Patent
Mead

(10) Patent No.: US 6,233,780 B1
(45) Date of Patent: May 22, 2001

(54) DUST PAN

(76) Inventor: Raymond Mead, 11011 Haradon Rd., Corning, NY (US) 14830

( * ) Notice: Subject to any disclaimer, the term of this patent is extended or adjusted under 35 U.S.C. 154(b) by 0 days.

(21) Appl. No.: 09/420,727

(22) Filed: Oct. 20, 1999

(51) Int. Cl.[7] ..... A47L 13/52

(52) U.S. Cl. ..... 15/257.3; 15/257.6; 15/257.7; 15/257.9; 294/55; D32/74

(58) Field of Search ..... 15/257.1–257.9; 294/1.3–1.5, 55; D32/74

(56) References Cited

U.S. PATENT DOCUMENTS

| | | | | |
|---|---|---|---|---|
| D. 123,510 | * | 11/1940 | Prentice | D32/74 |
| 371,612 | * | 10/1887 | McDougal | 15/257.7 |
| 452,696 | * | 5/1891 | Downing | 15/257.1 |
| 768,871 | * | 8/1904 | Albertson | 15/257.3 |
| 1,053,438 | * | 2/1913 | Resch | 15/257.3 |
| 4,048,692 | | 9/1977 | Coffey | 15/257.2 |
| 4,562,611 | | 1/1986 | Marttinen | 15/257.7 |
| 4,686,734 | | 8/1987 | Kahan | 15/257.1 |
| 4,709,440 | * | 12/1987 | Conelly | 15/257.3 |
| 5,031,277 | * | 7/1991 | Coker | 15/257.3 |
| 5,367,737 | | 11/1994 | Vosbikian et al. | 15/257.2 |
| 5,715,564 | * | 2/1998 | Knouse | 15/257.3 |

FOREIGN PATENT DOCUMENTS

| | | | | |
|---|---|---|---|---|
| 2499841 | * | 8/1982 | (FR) | 294/55 |
| 189994 | * | 12/1922 | (GB) | 15/257.3 |
| 478722 | * | 4/1936 | (GB) | 15/257.7 |

* cited by examiner

*Primary Examiner*—Mark Spisich
(74) *Attorney, Agent, or Firm*—Hedman & Costigan, P.C.

(57) ABSTRACT

A dust pan having improved structure for facilitating emptying of debris from the dust pan is disclosed.

15 Claims, 5 Drawing Sheets

DUST PAN

The present invention relates to a device for picking up debris. More particularly the present invention relates to an improved dust pan. Most particularly the present invention relates to a dust pan which provides improved means for removing the debris from the dust pan.

BACKGROUND OF THE PRESENT INVENTION

Dust pan of numerous shapes and sizes are known in the art. Dust pans are useful for cleaning in and about the home and commercial and industrial buildings. Dust pans typically have a broad shallow container or scoop attached to a handle, the scoop or container being open on one edge. The scoop is rested on the ground and a broom or other implement is used to push dust or other debris over the edge and into the scoop. The scoop is then manipulated like a shovel, to lift and dump the debris into a receptacle out of the same open end through which the debris or dust originally entered. Exemplary dust pan devices of the prior art include Coffey, U.S. Pat. No. 4,048,692; Marttinen, U.S. Pat. No. 4,562,611; Kahan, U.S. Pat. No. 4,686,734; and Vosbikian et al., U.S. Pat. No. 5,367,737.

However, all of the prior art dust pan devices suffer from a common drawback, namely, they have a tendency to spill a portion of the debris upon emptying. It would therefore solve a long felt need in the art if this drawback were to be overcome and a dust pan provided which was structured to substantially reduce if not eliminate spillage of debris when the dust pan is emptied.

SUMMARY OF THE PRESENT INVENTION

Figure 1:
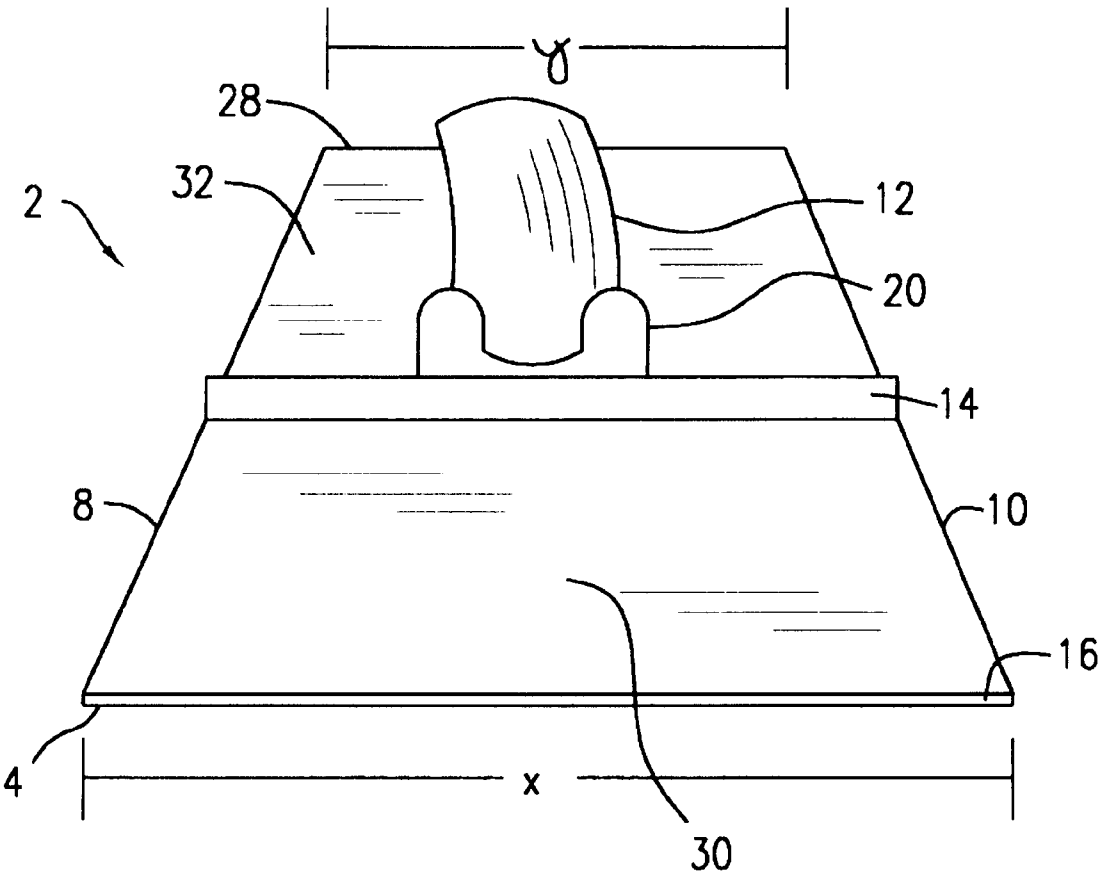
FIG. 1 is a front view of a preferred dust pan of the present invention.
Figure 2:
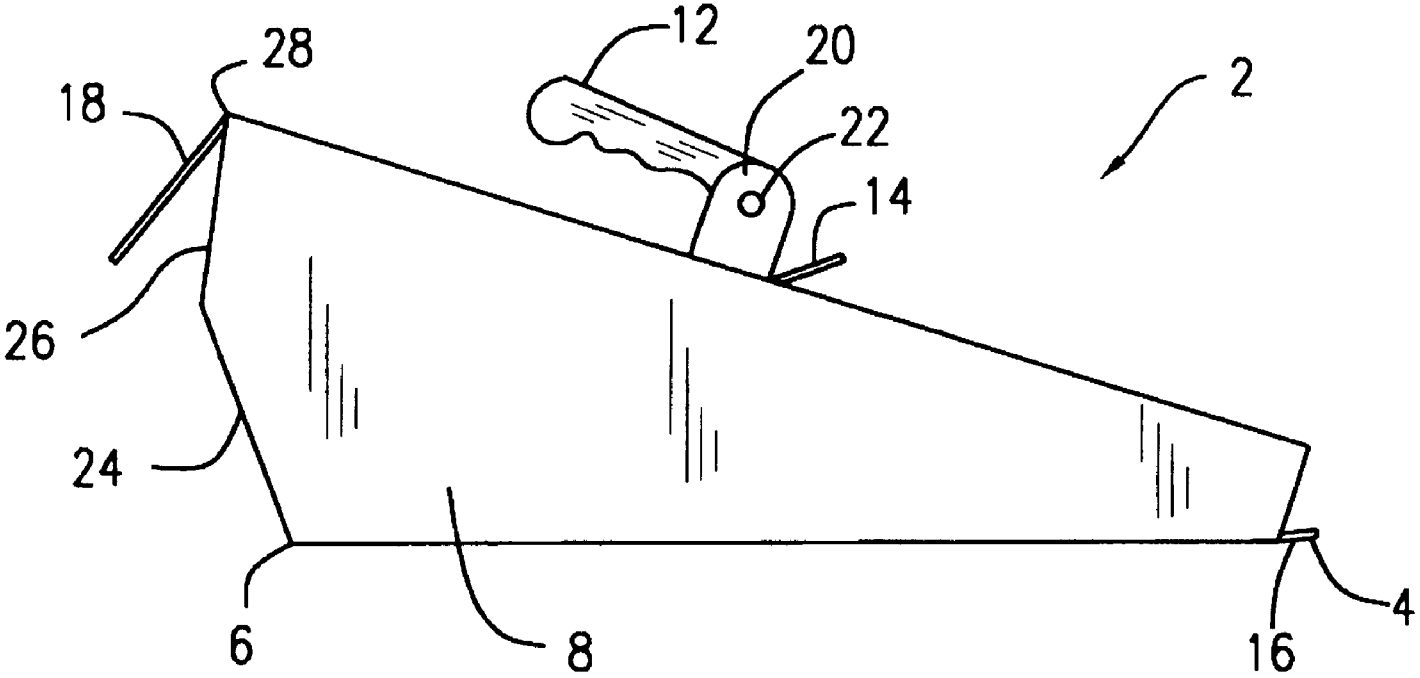
FIG. 2 is a side view of a preferred dust pan of the present invention.
Figure 3:
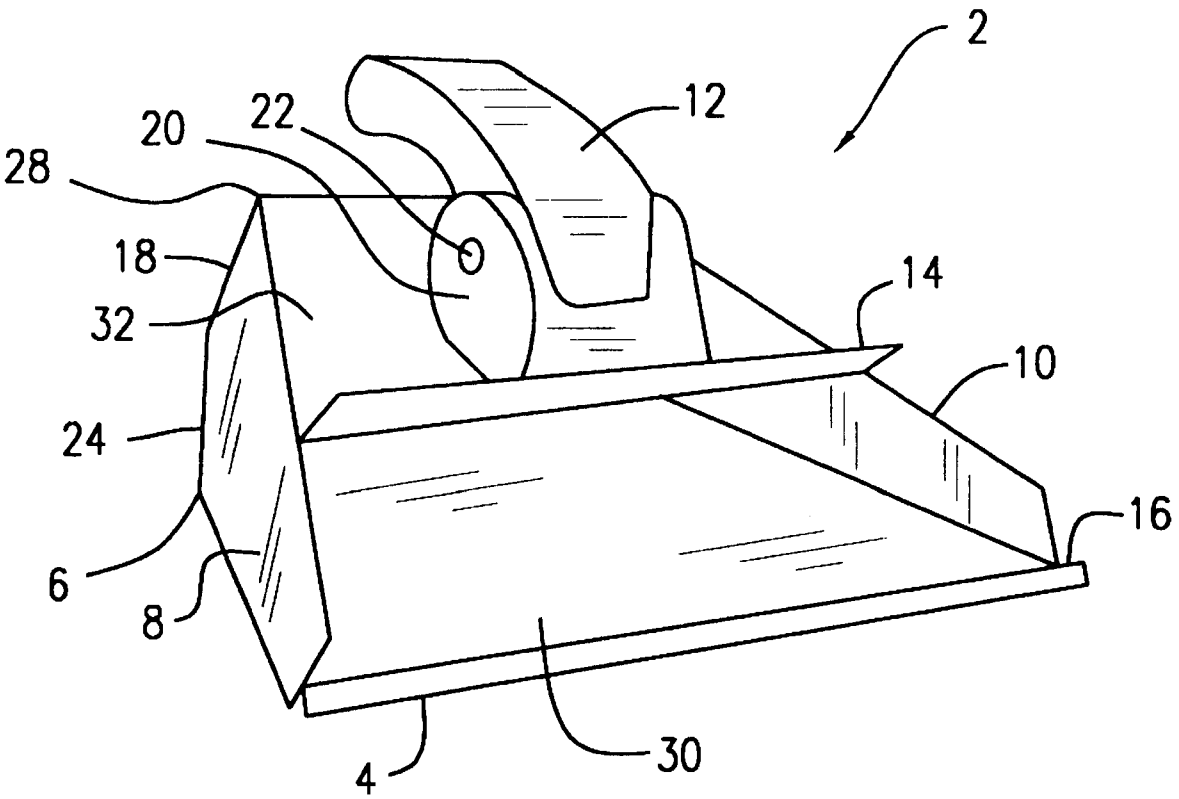
FIG. 3 is a front perspective view of a preferred dust pan of the present invention.
Figure 4:
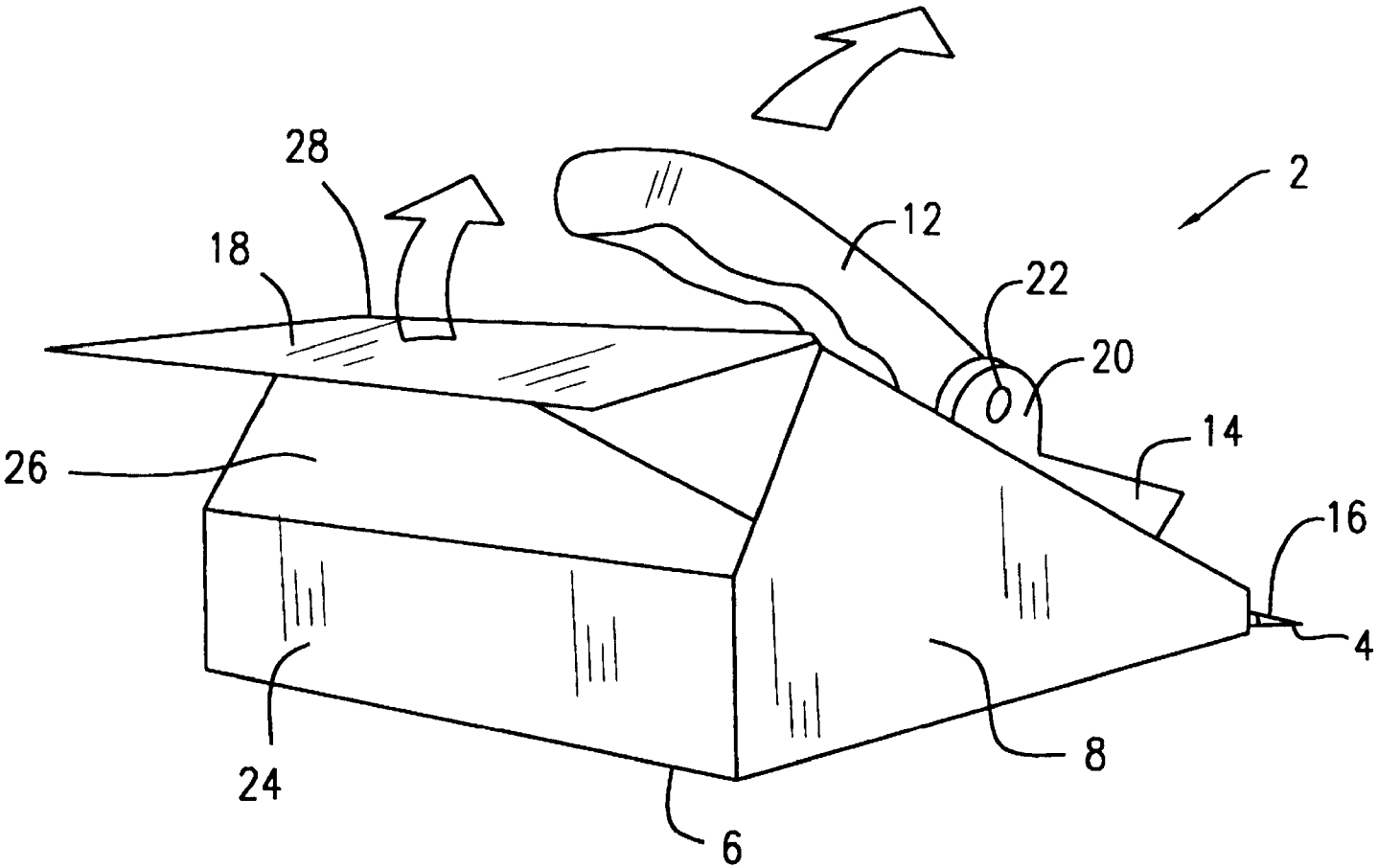
FIG. 4 is a rear perspective view of a preferred dust pan of the present invention.

The dust pan of present invention solves the problems of the prior art devices by providing an improved means for emptying out the debris contained in the dust pan. In this regard, the present invention provides a dust pan which is equipped with a rear emptying opening, and wherein the rear edge of the dust pan has a length which is at most about 75% of the length of the front edge of the dust pan.

In this manner, by providing a rear emptying opening and a shorter rear edge, the present inventor has found that substantially less debris is spilled when the dust pan is emptied, as opposed to dust pans which are emptied from the front opening.

Accordingly, the present invention provides a dust pan comprising the following components: (a) a relatively flat bottom panel having a front edge of length x, a back edge of length y, a left side edge and a right side edge; (b) a left side panel connected to the left side edge of the flat bottom panel and having back edge and a top edge; (c) a right side panel connected to the right side edge of the flat bottom panel and having a back edge and a top edge; (d) a substantially rectangular back panel attached to the back edge of the bottom panel and the back edges of the left side panel and right side panel; (e) a top panel attached to the top edges of the left side panel and the right side panel; wherein x is greater than y; wherein the back side panel has a height less than the height of the back edges of the left side panel and right side panel to thereby define an opening in the rear of said dust pan; and wherein said top panel has a length less than the length of the left side panel and right side panel to thereby define an opening in the front of said dust pan.

DETAILED DESCRIPTION OF THE PRESENT INVENTION

Referring to FIGS. 1–4 there is shown a preferred embodiment of a dust pan 2 of the present invention. The dust pan 2 has a front edge 4. In the preferred embodiment of FIGS. 1–4, the dust pan 2 is provided with a stiffener or break 16 along the front edge of the bottom panel. The inclusion of a stiffener 16 is not critical to the present invention, and a plain flat edge will suffice. The stiffener 16 provides improved stiffness to the edge.

The dust pan 2 also comprises two sides, 8 and 10 which extend from the front edge 4 of the bottom panel to back panel 24. The top edges of the two sides may slope upwardly from front to rear. At the bottom of back panel 24 is an edge 6. Front edge 4 has a length x and back edge 6 has a length y. It is critical to the present invention that length x be greater than length y, typically where x is at least about 25% greater than y. In preferred embodiments, x is at least about 30% greater than y, more preferred is where x is at least about 35% greater than y, and most preferred is where x is at least about 40% greater than y. For example, where x is 18 inches, y could range from about 13.5 inches to about 10.8 inches.

Above the back panel is a rear opening 26 which is preferably covered by back hinged panel 18. The back hinged panel 18 is hinged along the top edge 28 of top panel 32. The inclusion of back hinged panel 18 is not critical to the present invention and may be omitted. However, in a preferred embodiment, to further prevent any debris from being swept directly through back opening 26. The hinged back panel 18 is provided such that it closes off opening 26 while the dust pan 2 is in the horizontal position, but readily opens (as shown by the arrow shown in FIG. 4) when the dust pan 2 is tilted backwards for emptying operation.

The top panel 32 is provided between the two sides 8 and 10 and extends about one-half to two-thirds of the way down from the rear edge 28 towards the front edge 4. The amount that top panel 32 extends is not particularly critical to the present invention, as long as there is provided a sufficient opening 30 in the front of the dust pan 2 so that debris may be swept into the interior of the dust pan 2. The front edge of the top panel 32 may optionally be provided with a stiffener 14.

Figure 5:
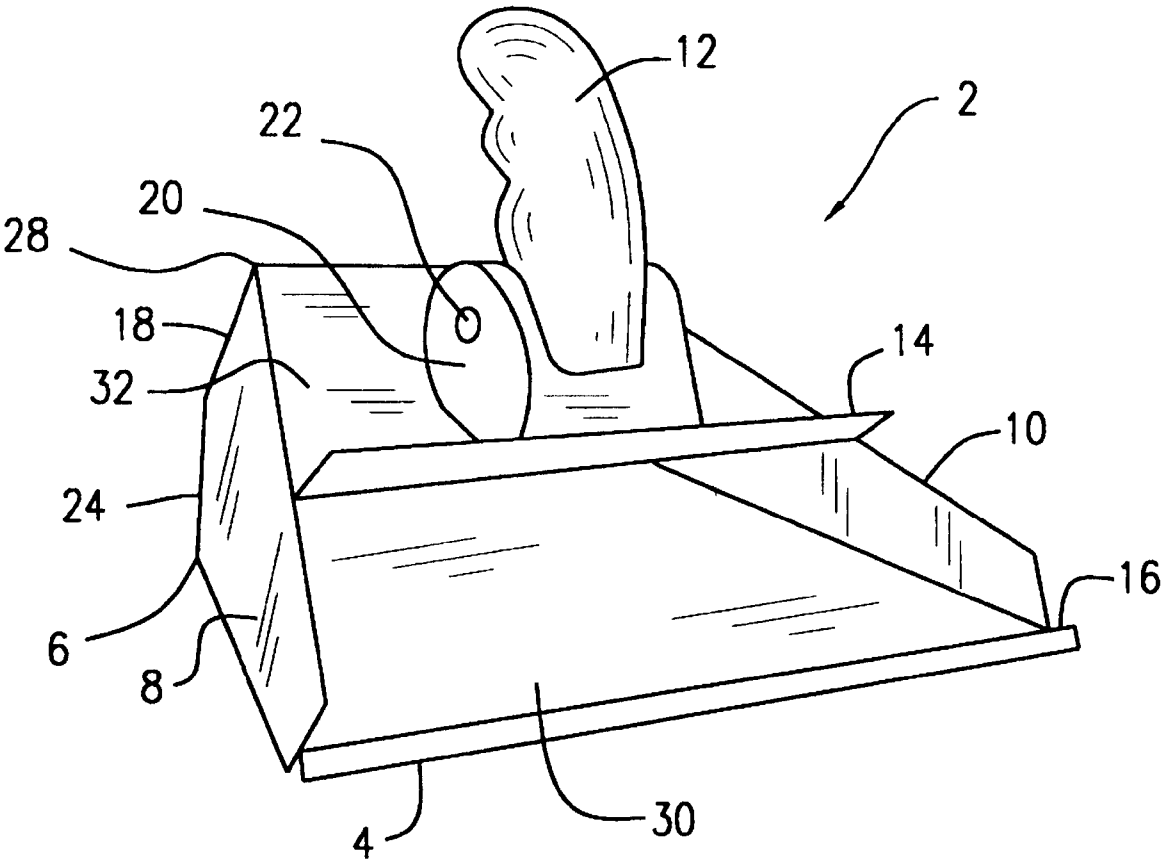
FIG. 5 is a front perspective view of an alternative embodiment of a dust pan of the present invention.

On top of top panel 32 there is provided a handle housing 20 to which is attached a handle 12. In a preferred embodiment, the handle is attached via a pin 22 to housing 20. In yet another preferred embodiment the handle 12 may pivot from a substantially horizontal position as shown in FIGS. 1 to 4, to substantially vertical position as shown in FIG. 5. In this embodiment, it is also contemplated by the present invention that an extension attachment (not shown) may be provided which may attach to the handle in any means known to those skilled in the art. In this manner, with the extension attached to the dust pan, the dust pan may be used from a standing position.

It is further contemplated by the present invention that provision is made for the attachment of a bag or container to be attached to the dust pan to cover the rear opening. The bag or container may be attached via any means known to those of ordinary skill in the art, including a device such as a twist lock feature.

The dust pan of the present invention provides an improved method of cleaning up debris from a flat surface, with substantially less spillage of the debris back onto the flat surface when the dust pan is emptied. The debris is swept into the front opening of the dust pan with any suitable sweeping means, such as a broom or a whisk broom. The dust pan is then lifted, preferably slightly tilted backwards to prevent spillage out of the front opening. Then the rear opening is placed over a suitable waste receptacle and the debris falls out of the rear opening.

Advantageously, the dust pan of the present invention is especially useful for cleaning relatively large surfaces such as floors and walkways. The dust pans of the present invention can have relatively large front openings, such as on the order of 3 or 4 feet, or even larger, and still provide a small enough opening in the rear of the dust pan such that there is substantially no spillage of the debris into the waste receptacle. This enables the user to clean larger areas with less spillage and in a quicker fashion.

Many variations of the present invention will suggest themselves to those skilled in the art in light of the above-detailed description. All such obvious modifications are within the full intended scope of the appended claims.

All of the above-referenced patents are hereby incorporated by reference.

What is claimed is:

1. A dust pan comprising the following components:

(a) a substantially flat bottom panel having a front edge of length x, a back edge of length y, a left side edge and right side edge;

(b) a left side panel connected to the left side edge of the bottom panel and having a back edge and a top edge;

(c) a right side panel connected to the right side edge of the bottom panel and having a back edge and a top edge;

(d) a substantially rectangular back panel attached to extending from the back edge of the bottom panel and attached to the back edges of the left and right side panels;

(e) a substantially flat top panel attached to the top edges of the left and right side panels; and wherein, x is greater than y, the top edges of the left and right side panels are substantially straight and upwardly taper from the front to the back of the dust pan, the back panel has a height less than the back edges of the left and right side panels whereby a rear opening is defined between the upper edge of the back panel and a lower surface of the top panel through which debris collected by said pan may be emptied, and the top panel has a length less than the length of the left and right side panels to thereby define an opening in the front of the dust pan.

2. A dust pan as defined in claim 1 wherein said top panel further comprises a handle attached to the top surface of the top panel.

3. A dust pan as defined in claim 2 wherein said handle is attached in a hinged relation to said top surface of the top panel.

4. A dust pan as defined in claim 2 further comprising a handle extension means which is adapted to attach to said handle.

5. A dust pan as defined in claim 1 further comprising a back cover panel hingeably attached to a back edge of the top panel for substantially covering said rear opening.

6. A dust pan as defined in claim 1 wherein x is at least about 25% greater than y.

7. A dust pan as defined in claim 6 wherein x is at least about 30% greater than y.

8. A dust pan as defined in claim 7 wherein x is at least about 35% greater than y.

9. A dust pan as defined in claim 8 wherein x is at least about 40% greater than y.

10. A dust pan as defined in claim 1 wherein x is about 18 inches, and y ranges from about 13.5 inches to about 10.8 inches.

11. A dust pan as defined in claim 1 wherein said front edge of said bottom panel is provided with a stiffener.

12. A dust pan as defined in claim 1 wherein a front edge of said top panel is provided with a stiffener.

13. A dust pan as defined in claim 1 wherein said rear opening is substantially rectangular.

14. A dust pan as defined in claim 1 wherein the height of said back panel is approximately one-half of the height of the back edges of the left side panel and right side panel.

15. A dust pan as defined in claim 1 wherein the length of said top panel is approximately one-half of the length of the left side panel and right side panel.

* * * * *